US005529056A

United States Patent [19]

Brunson et al.

[11] Patent Number: 5,529,056

[45] Date of Patent: Jun. 25, 1996

[54] APPARATUS AND METHOD FOR TESTING RESPIRATOR FIT AND SEAL

[75] Inventors: Kevin K. Brunson, Argyle; Diana M. Szygenda, N. Richland Hills both of Tex.

[73] Assignee: Tecnol Medical Products, Inc., Fort Worth, Tex.

[21] Appl. No.: 289,697

[22] Filed: Aug. 12, 1994

[51] Int. Cl.[6] ..... A62B 27/00

[52] U.S. Cl. ..... 128/200.24; 128/206.19; 128/909; 128/206.24; 128/206.25; 73/40

[58] Field of Search ..... 128/206.21, 200.24, 128/909, 205.25, 206.12, 201.23, 206.19, 202.12, 206.23, 206.24, 206.28, 206.25; 73/38, 40

[56] References Cited

U.S. PATENT DOCUMENTS

| | | | |
|---|---|---|---|
| D. 249,072 | 8/1978 | Revoir | D 29/8 |
| 3,580,051 | 5/1971 | Blevins | 73/38 |
| 3,688,768 | 9/1972 | Reimschussel | 128/146.2 |
| 4,146,025 | 3/1979 | Warncke et al. | 73/40 |
| 4,197,841 | 4/1980 | Brauer et al. | 128/202.13 |
| 4,454,881 | 6/1984 | Huber, et al. | 128/206.19 |
| 4,606,341 | 8/1986 | Hubbard, et al. | 128/206.17 |
| 4,635,628 | 1/1987 | Hubbard, et al. | 128/201.17 |
| 4,641,645 | 2/1987 | Tayebi | 128/206.19 |
| 4,674,492 | 6/1987 | Niemeyer | 128/202.22 |
| 4,683,880 | 8/1987 | Werjefelt | 128/201.28 |
| 4,688,566 | 8/1987 | Boyce | 128/206.19 |
| 4,765,325 | 8/1988 | Crutchfield | 128/203.13 |
| 4,832,011 | 5/1989 | Busch | 128/202.13 |
| 4,846,166 | 7/1989 | Willeke | 128/200.24 |
| 4,905,683 | 3/1990 | Cronjaeger | 128/202.22 |
| 4,914,957 | 4/1990 | Dougherty | 73/40 |
| 5,115,804 | 5/1992 | Brookman | 128/201.22 |
| 5,182,941 | 2/1993 | Frenkel et al. | 73/40 |
| 5,289,819 | 3/1994 | Kruger et al. | 128/200.24 |
| 5,299,448 | 4/1994 | Maryyanek et al. | 73/40 |
| 5,322,061 | 6/1994 | Brunson | 128/206.13 |
| 5,351,008 | 9/1994 | Leach et al. | 73/40 |

OTHER PUBLICATIONS

*Federal Register*, Part II, Department of Health and Human Services, Oct. 12, 1993, pp. 52811 and 52843–5.

*Primary Examiner*—Edgar S. Burr
*Assistant Examiner*—William J. Deane, Jr
*Attorney, Agent, or Firm*—Baker & Botts

[57] ABSTRACT

Apparatus for use in checking the fit of a respirator with the face of a wearer. The apparatus may include a generally rectangular envelope having a longitudinal opening to receive the respirator therein. Low adhesive contact surfaces may be formed within the interior of the opening to form a fluid barrier with the periphery of the respirator. One or more passageways, formed within the apparatus, may be opened and closed to test the fit or seal between the periphery of the respirator and the face of the wearer. The envelope may be used to check the fit of a wide variety of types and styles of respirators and face masks. Envelopes with configurations other than rectangular may also be satisfactorily used to check the fit of a respirator.

22 Claims, 3 Drawing Sheets

APPARATUS AND METHOD FOR TESTING RESPIRATOR FIT AND SEAL

TECHNICAL FIELD OF THE INVENTION

This invention relates in general to disposable medical products, and in particular, but not by way of limitation, to an apparatus for checking the fit of respirator type face masks.

BACKGROUND OF THE INVENTION

Wearing protective face masks has become standard procedure for many health care and other related activities. The use of a face mask is important, for example, to lab technicians while conducting tests, to nurses in the care of patients, to physicians during surgery and other medical treatment, and to dentists working in a patient's mouth.

The rapid increase of infectious diseases, particularly AIDS, has made the use of such protective equipment increasingly important. The Center for Disease Control in Atlanta, Ga., has found that the AIDS virus (HIV) can be passed by contact with body fluids. Contact of AIDS contaminated body fluids with another person's source of body fluids, e.g., eyes, nose, mouth, etc., can pass the disease.

During the past several years, health care personnel have become more aware of the potential hazards associated with airborne pathogens, such as the hepatitis B virus and infectious tuberculosis (TB) associated with many HIV patients. It has been found that aerosols having airborne liquid and solid particles are generated not only by the exhalation of infected patients, but also by certain procedural manipulations and processes that impart energy to microbial suspensions. Also, many viral hemorrhagic fevers such as yellow fever, rift valley fever and perhaps rocky mountain spotted fever, rabies and smallpox can be transmitted through aerosols. A considerable number of studies have been made which are now beginning to identify the transmission of viruses through "non-accident" situations. Accordingly, there is an increased interest in using face masks or respirators which form a complete seal around the periphery of the mask and at the same time are easy to put on and comfortable to wear. Many face masks which are presently available allow the passage of fluids and/or aerosols between the periphery of the mask and the wearer's face.

The Department of Health and Human Services through the Centers for Disease Control and Prevention are currently preparing "Guidelines For Preventing The Transmission Of Tuberculosis In Health Care Facilities, Second Addition". One of the items which will be emphasized in the new guidelines is personal respiratory protection. The response to the draft guidelines published by the Department of Health and Human Services demonstrates the increased interest and importance of reducing the risk of tuberculosis transmission within health care facilities. The use of personal respiratory protective equipment in areas where there is a risk of exposure to mycobacterium tuberculosis such as tuberculosis isolation rooms where personnel with infectious tuberculosis are isolated is one of the important features of the new guidelines intended to reduce the risk to health care personnel.

The following comments are taken from the draft guidelines as published in the Federal Register, Volume 58, No. 195, Tuesday, Oct. 12, 1993, pages 52843–52845.

"Personal respiratory protection should be used by persons entering rooms where patients with known or suspected infectious TB are being isolated, during cough-inducing or aerosol-generating procedures on patients with known or suspected infectious TB, and in other settings where administrative and engineering controls are not likely to protect persons from inhaling infectious airborne droplet nuclei." Page 52843.

"Face-seal leakage. Face-seal leakage comprises the ability of particulate respirators to protect the worker from airborne material (148—ANSI1980, 149—Hyatt1963, 150—ANSI1961). A proper seal between a respirator's sealing surface and a wearer's face is essential for effective and reliable performance of any negative-pressure respirator. It is less critical, but still important, for a positive-pressure respirator. Face-seal leakage can result from factors such as incorrect facepiece size or shape, incorrect or defective facepiece sealing-lip, beard growth on a wearer, perspiration or facial oils that can result in facepiece slippage, failure to use all the headstraps, incorrect positioning of a facepiece on a wearer's face, incorrect headstrap tension or position, improper mask maintenance, and mask damage.

The mechanism of action of negative-pressure (non-powered) particulate respirators is based on the same principle. During each inhalation by a wearer, a negative pressure (relative to the workplace air) is created inside the facepiece of this type of respirator. Due to this negative pressure, air containing contaminants can take a path of least resistance into the respirator—through leaks at the face-seal interface—thus avoiding the higher-resistance filter material. Currently available, cup-shaped, disposable particulate respirators have 0% to 10% (148—ANSI1980) to 20% (151—NIOSH1987, 152—DCCIR1987) face-seal leakage. This leakage through the face seal results from limitations in the design, construction, number of sizes available of these masks, and the variability of the human face. The face-seal leakage is assumed to be even higher if the respirators are not properly fitted to the wearer's face, tested for an adequate fit by a qualified individual, and then checked for fit by the wearer every time these masks are dionned. Face-seal leakage may be reduced to less than 10% with improvements in design and more available sizes, combined with appropriate fit testing and fit checking." Page 52844.

"Fit Checking. A fit check is a maneuver that a HCW performs before each use of the respiratory protective device to check the fit. The fit check can be performed according to the manufacturer's facepiece fitting instructions or using a negative pressure test or a positive pressure test (Table S4-3).

Some currently available cup-shaped disposable negative-pressure particulate respirators with DM, DFM, or HEPA filters cannot be reliably fit checked by wearers (152—DCCIR1987), because it is difficult to occlude the entire surface of the filter. Strategies for overcoming these limitations are under development by respirator manufacturers but have not been evaluated." Page 52845.

SUMMARY OF THE INVENTION

In accordance with the present invention, apparatus and methods are provided to substantially reduce or eliminate the shortcomings previously associated with fit checking of disposable type respirators and other face masks. The present invention provides a simple, reliable means for checking the facial fit of a respirator or face mask each time the respirator or face mask is donned. The present invention results in cost effective apparatus and methods to perform a quick check of facial fit without interfering with the performance of the respirator or mask.

One aspect of the present invention provides apparatus for checking the fit of various types of respirators with the face of a health care worker before each use of the respirator. The apparatus is preferably used to perform a negative pressure fit check after the respirator has been placed over the nose and mouth of the health care worker. The apparatus includes a fluid impervious envelope which forms a fluid barrier with the periphery of the respirator and prevents air flow through the respirator.

Significant technical advantages of the present invention include the ability to conduct a fit check of dust mist, dust mist fume, and high efficiency particulate air type face masks. Apparatus incorporating the present invention may be used to conduct a fit check of many various types of respirators and face masks which form a fluid seal between the periphery of the respective respirator or mask and the wearers' face.

Another aspect of the present invention includes an envelope having low adhesive contact surfaces which may be used to engage the periphery of a respirator after the respirator has been placed on the face of a wearer. One or more passageways in the envelope may be easily opened and closed by the wearer to block air flow through the envelope to test the fit of the respirator with the wearers' face.

Additional technical advantages of the present invention include providing an envelope formed from flexible, fluid impervious film. The envelope preferably includes a longitudinal opening with low adhesive contact surfaces for engagement with the periphery of a respirator. Paper strips may be placed within the longitudinal opening of the envelope to protect the low adhesive contact surfaces prior to testing a respirator. The paper strips preferably extend beyond the respective edges of the longitudinal opening to allow easy removal of each strip.

BRIEF DESCRIPTION OF THE DRAWINGS

For a more complete understanding of the present invention and for the advantages thereof, reference is now made to the following description taken in conjunction with the accompanying drawings, in which.

DETAILED DESCRIPTION OF THE INVENTION

The preferred embodiments of the present invention and its advantages are best understood by referring to FIGS. 1–5 of the drawings, like numerals being used for like and corresponding parts of the various drawings.

The following abbreviations and acronyms are used in this patent application.

| | |
|---|---|
| Tuberculosis | TB |
| Health care worker | HCW |
| Dust mist | DM |
| Dust mist and fume | DMF |
| High efficiency particulate air | HEPA |

Also, for purposes of this patent application, the term respirator is used to include any face mask which forms a fluid barrier between the periphery of the mask and the wearers' face. Such respirators include, but are not limited to, cup style or cone style face masks, DM, DMF, and HEPA filter masks. The term "fluid" is used within this patent application to include any gas, liquid, or mixture of gas and liquid. Particulate matter and aerosols may also be entrained within such fluids. For purposes of this patent application, aerosols are defined as insoluble liquids or particulate matter frequently associated with microbial solutions.

Figure 1:
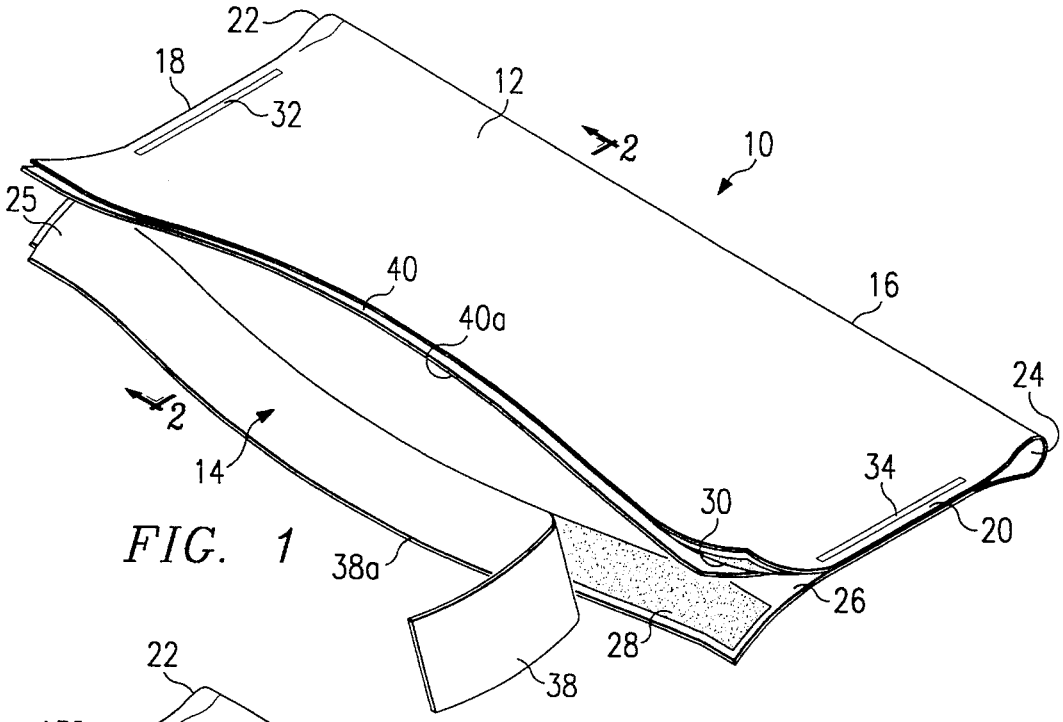
FIG. 1 is a perspective view of an envelope incorporating one embodiment the present invention for use in fit checking or testing respirators.
Figure 1A:
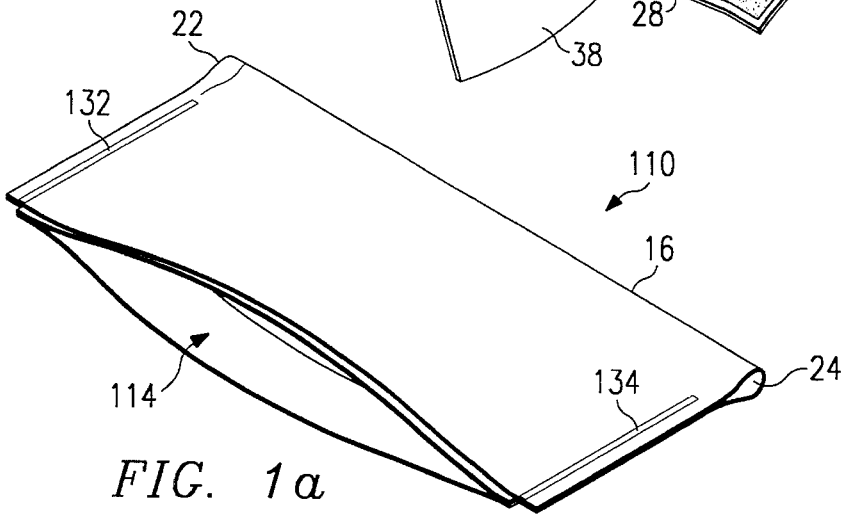
FIG. 1*a* is a perspective view of an envelope incorporating an alternative embodiment of the present invention for fit checking respirators.
Figure 1B:
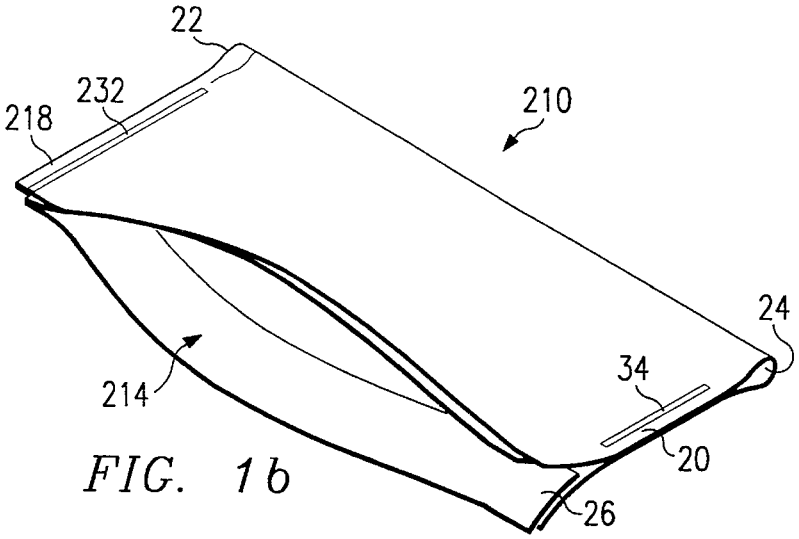
FIG. 1*b* is a perspective view of an envelope incorporating still another embodiment of the present invention for fit checking respirators.
Figure 2:
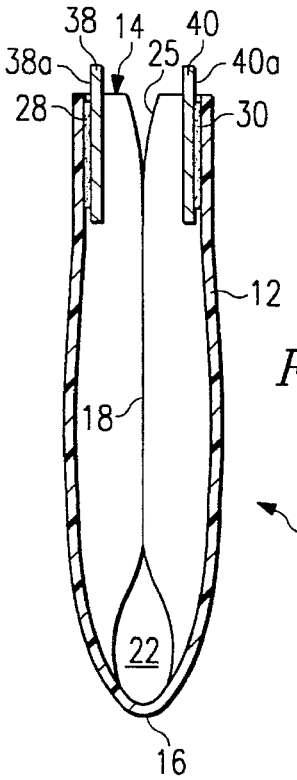
FIG. 2 is a drawing in section taken along line 2—2 of FIG. 1.
Figure 3:
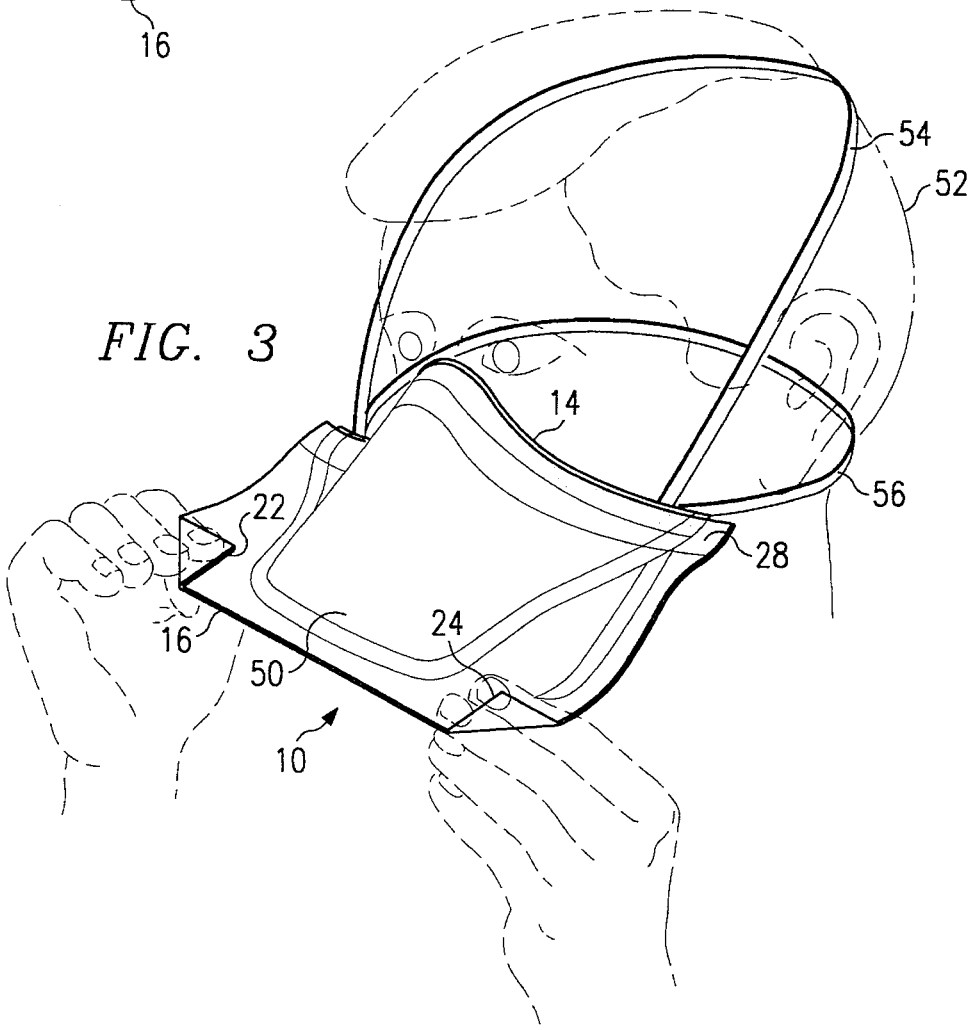
FIG. 3 is an elevational view of the envelope of FIG. 1 being used to check the fit between the periphery of a respirator and the face of a wearer.

Envelope 10 as shown in FIGS. 1, 2 and 3 provides apparatus for checking the fit of respirator 50 with the face of wearer 52. FIGS. 1*a* and 1*b* show envelopes 110 and 210 respectively, which incorporate alternative embodiments of the present invention.

Envelope 10 is preferably formed from sheet 12 of fluid impervious, flexible material having a thickness of approximately one thousandth of an inch. Various types of plastic membrane material such as polyethylene or polypropylene may be used to provide sheet 12. Sheet 12 is preferably folded to form envelope 10 having a generally rectangular cross section with opening 14 formed on one longitudinal side and the other or second longitudinal side 16 closed. Lateral sides 18 and 20 of envelope 10 are generally sealed by bonded areas 32 and 34 respectively except for passageways 22 and 24 adjacent to longitudinal side 16 and slots 25 and 26 adjacent to longitudinal opening 14.

Low adhesive contact surfaces 28 and 30 are preferably formed on the interior of opening 14 and extend longitudinally for approximately the full length thereof. Paper strips 38 and 40 are preferably disposed on their respective low adhesive contact surfaces 28 and 30. A portion 38*a* and 40*a* of each respective paper strip 38 and 40 preferably extends from opening 14 to facilitate easy removal of respective paper strip 38 and 40. Low adhesive contact surfaces 28 and 30 and removable paper strips 38 and 40 are available from 3M Company under its Post-It brand of products and may satisfactory be use with the present invention.

Envelope 10 may be used to check the fit of respirator or face mask 50 with the face of wearer 52 by using the following procedure. Respirator 50 is placed on the face of wearer 52 and straps 54 and 56 adjusted to provide the desired fit with the face of wearer 52. Envelope 10 is opened to allow removal of paper strips 38 and 40 from their respective low adhesive contact surfaces 28 and 30. Envelope 10 may then be placed over face mask 50 by inserting face mask 50 within longitudinal opening 14. Low adhesive contact surfaces 28 and 30 are engaged with the periphery of respirator 50 adjacent to the face of wearer 52.

An important step in the fit check process is to insure that low adhesive contact surfaces 28 and 30 do not contact the face of wearer 52. For one application of the present invention, low adhesive contact surfaces 28 and 30 are limited in width to approximately one-half inch (½") to minimize any possible contact with the face of wearer 52 during the fit check process.

When envelope 10 has been placed over face mask 50 and properly engaged with the periphery of face mask 50, wearer 52 can breath normally as long as passageways 22 and 24 remain open. The fit of face mask 50 with the face of wearer 52 may be checked by closing passageways 22 and 24 as shown in FIG. 3. An important feature of the present invention is forming envelope 10 from relatively flexible, fluid impervious material which may be easily folded to block air flow through passageways 22 and 24 as shown in FIG. 3. If face mask 50 is properly engaged with the face of wearer 52, wearer 52 will not be able to breath when passageways 22 and 24 have been closed. If face mask 50 fits properly, no leakage should be detected between the periphery of face mask 50 and the face of wearer 52.

As previously noted, the fit of various types of face masks and respirators may be satisfactorily checked with an envelope incorporating the present invention. Face mask 50 is more fully described in pending U.S. patent application Ser. No. 07/991,154 filed Dec. 16, 1992 now U.S. Pat. No. 5,322,061.

Envelope 110 shown in FIG. 1*a* represents an alternative embodiment of the present invention in which bonded areas 132 and 134 extend from the respective openings 22 and 24 to the edge of longitudinal opening 114. Thus, envelope 110 does not contain slots 25 and 26. For some applications, it may be preferable to provide longitudinal opening 114 without slots 25 and 26.

Envelope 210 shown in FIG. 1*b* represents another alternative embodiment of the present invention. Bonded area 232 on lateral side 218 extends from opening 22 to the extreme edge of longitudinal opening 214. Bonded area 234 extends from opening 24 only as far as slot 26. For some types of respirators, it may be preferable to have lateral side 218 closed as shown in FIG. 1*b* with only lateral side 20 having slot 26. An important feature of the present invention is the ability to provide a fluid impervious envelope having a longitudinal opening 14, 114 or 214 with the desire configuration for use in checking the fit of various styles of respirators.

Figure 4:
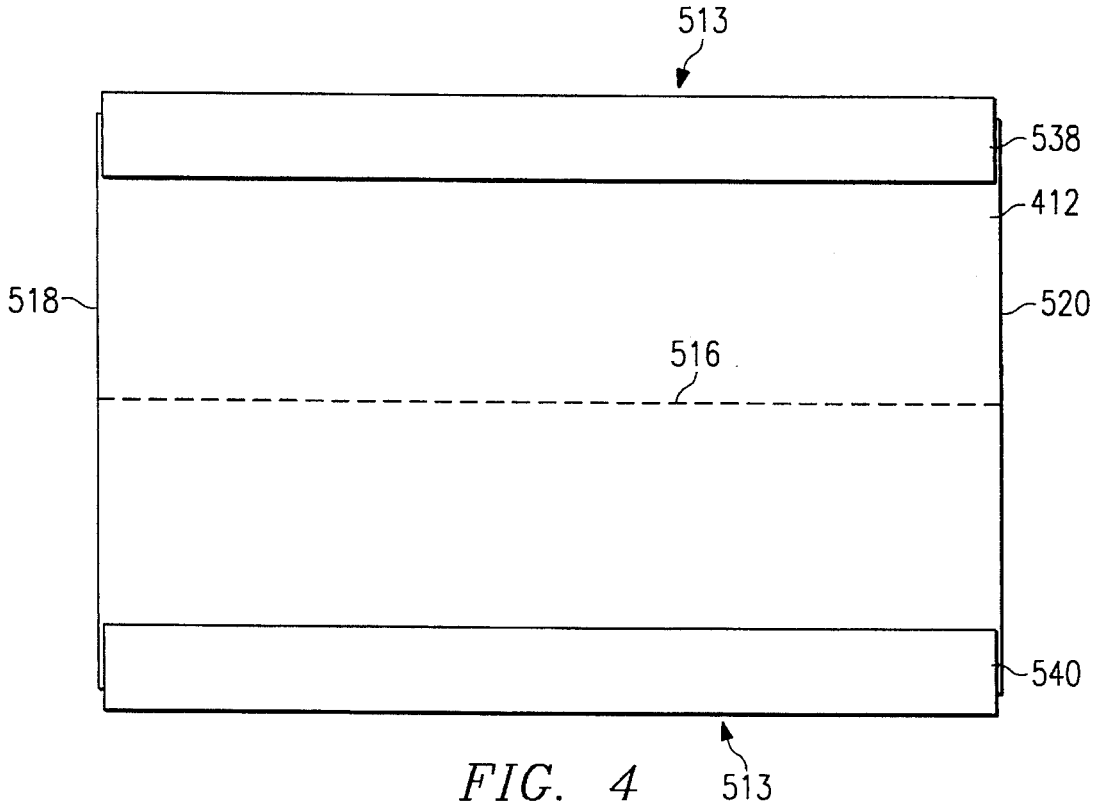
FIG. 4 is a plan view showing a flexible sheet of fluid impervious material which may be used to form an envelope for fit checking respirators.
Figure 5:
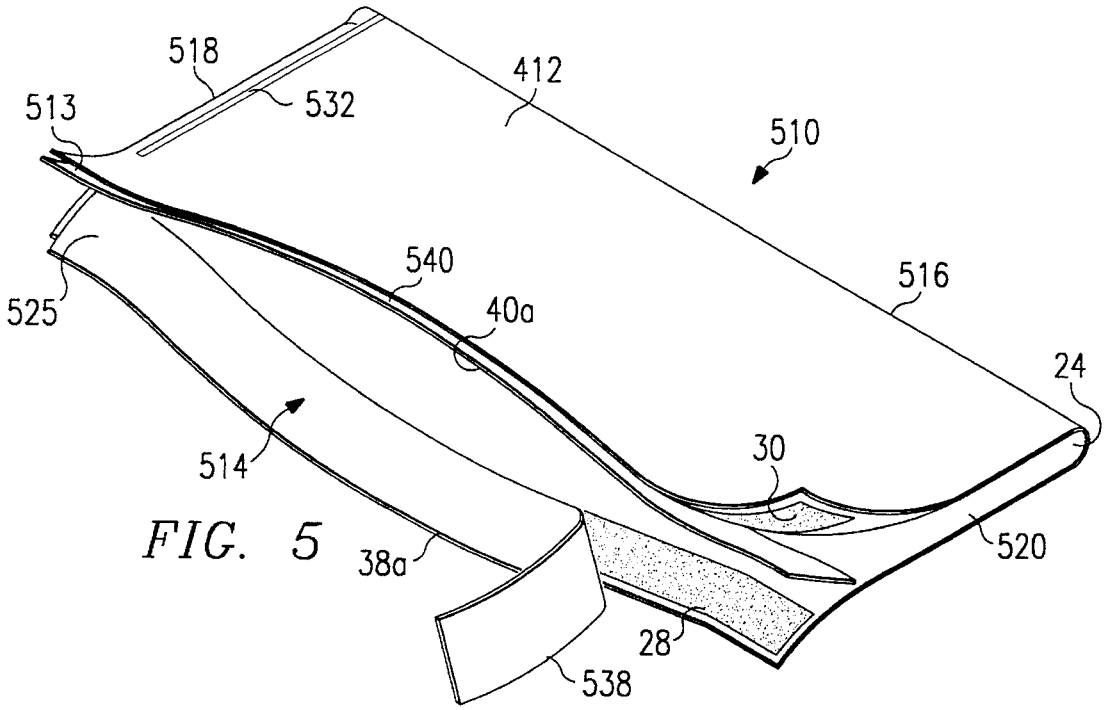
FIG. 5 is a perspective view of an envelope formed from the flexible sheet of FIG. 4 incorporating a further embodiment of the present invention for fit checking respirators.

Flexible sheet 412 shown in FIG. 4 and the resulting envelope 510 shown in FIG. 5 provide an alternative apparatus for checking the fit of respirator 50 with the face of wearer 52. Sheet 412 may be formed from the same fluid impervious, flexible material as previously described with respect to sheet 12. Sheet 412 may be folded to form envelope 510 having a generally rectangular cross-section with opening 514 formed in first longitudinal side 513. The second or other longitudinal side 516 is preferably closed. For some applications, envelope 510 could be formed from two sheets of material bonded along second longitudinal side 516 rather than folded.

First lateral side 518 of envelope 510 is preferably sealed by bonded area 532 from second longitudinal side 516 to slot 525. Second lateral side 520 is preferably fully open or unsealed from second longitudinal side 516 to first longitudinal side 513. Low adhesive contact surfaces 28 and 30 are preferably formed on the interior of opening 514 and extend longitudinally for approximately the full length of first longitudinal side 513. Paper strips 538 and 540 are preferably disposed on their respective low adhesive contact surfaces 28 and 30. Paper strips 538 and 540, along with low adhesive contact surfaces 28 and 30 may be formed from the same types of materials as previously described for envelope 10.

Envelope 510 may be used to check the fit of respirator or face mask 50 with the face of wearer 52 by using the following procedure. Respirator 50 is first placed on the face of wearer 52 and straps 54 and 56 adjusted to provide the desired fit and seal with the face of wearer 52. Second lateral side 520 is opened and paper strips 538 and 540 removed from their respective low adhesive contact surfaces 28 and 30. Envelope 510 may then be placed over face mask 50 by using open side 520 and first longitudinal opening 514 in cooperation with each other. Since first lateral side 518 is closed except for slot 525, first lateral side 518 and second longitudinal side 516 cooperate with each other to form a gauge or guide for placing envelope 510 over respirator 50. When the closed portions of envelope 510 have been properly engaged with respirator 50, low adhesive contact areas 28 and 30 may be engaged with the periphery of respirator 50 adjacent to wearer 52. As previously noted, an important step in the check process is to ensure that low adhesive contact surfaces 28 and 30 do not contact the face of wearer 52.

When envelope 510 has been placed over face mask 50 and properly engaged with the periphery of face mask 50, wearer 52 can breath normally as long as second lateral side 520 remains open. If face mask 50 is properly engaged with the face of wearer 52, wearer 52 will not be able to breath when second lateral side 520 has been manually closed by wearer 52. If wearer 52 can breath when second lateral side 520 is closed, it indicates leakage between the periphery of face mask 50 and the face of wearer 52. Also since second lateral side 520 is normally open, envelope 510 may be easily removed from respirator 50 upon completion of the fit check without disturbing the fluid seal between the periphery of face mask 50 and the face of wearer 52.

The present invention may be used with envelopes having various configurations other than rectangular. For example, sheet 12 or 412 could be folded in the shape of a square or a triangle. The only requirement is that the resulting envelope have a longitudinal opening such as 14, 114, 214 or 514 with low adhesive contact surfaces 28 and 30 and at least one passageway formed in the envelope for controlling the flow of air from the exterior of the envelope to the interior of the envelope. For some applications, a triangular configuration (not shown) may be used with longitudinal opening 14 along one side of the triangle and the air passageway formed at the angle opposite from opening 14.

Although the present invention and its advantage have been described in detail, it should be understood that various changes, substitutions and alterations can be made without departing from the spirit and scope of the invention as defined by the following claims.

What is claimed is:

1. Apparatus for checking the fit of a respirator with the face of a wearer comprising:

an envelope formed from a sheet of flexible, fluid impervious material;

a longitudinal opening formed in one side of the envelope and extending substantially the full length thereof;

at least one passageway formed in the envelope for controlling the flow of air from the exterior of the envelope to the interior of the envelope;

low adhesive contact surfaces formed on the interior of the envelope adjacent to the longitudinal opening; and the apparatus being engageable with the periphery of the respirator.

2. The apparatus as defined in claim 1 further comprising:

the envelope having a generally rectangular configuration with first and second longitudinal sides and first and second lateral sides extending between the first and second longitudinal sides;

the longitudinal opening formed in the first longitudinal side of the envelope;

the second longitudinal side of the envelope closed; and the passageway formed in one of the lateral sides of the envelope adjacent to the second longitudinal side.

3. The apparatus as defined in claim 1 further comprising a strip of paper placed on each low adhesive contact surface.

4. The apparatus as defined in claim 3 wherein each paper strip extends partially from the longitudinal opening.

5. The apparatus as defined in claim 1 further comprising:

the envelope having a generally rectangular configuration with first and second longitudinal sides and first and second lateral sides extending between the first and second longitudinal sides;

the longitudinal opening formed in the first longitudinal side of the envelope; and the second longitudinal side of the envelope closed.

6. The apparatus as defined in claim 5 wherein the low adhesive contact surfaces further comprise:

a first surface extending parallel for substantially the full length of one side of the longitudinal opening; and a second surface extending parallel for substantially the full length of the longitudinal opening.

7. Apparatus for checking the fit of a respirator with the face of a wearer comprising:

an envelope formed from a sheet of flexible, fluid impervious material and folded to have a generally rectangular configuration with first and second longitudinal sides and first and second lateral sides extending between the longitudinal sides;

an opening formed in the first longitudinal side of the envelope and extending substantially the full length thereof;

the second longitudinal side of the envelope closed;

at least one passageway formed in the envelope for controlling the flow of air from the exterior of the envelope to the interior of the envelope;

low adhesive contact surfaces formed on the interior of the envelope adjacent to the longitudinal opening; and the apparatus being engageable with the periphery of the respirator.

8. The apparatus as defined in claim 7 further comprising the passageway formed in one of the lateral sides of the envelope.

9. A method of checking the fit of a respirator which forms a fluid barrier with the face of a wearer comprising the steps of:

placing a fluid impervious envelope having a longitudinal opening over the exterior of the respirator and forming a fluid seal between the longitudinal opening of the envelope and the periphery of the respirator; and opening and closing a passageway between the exterior of the envelope and the interior of the envelope to check the fluid barrier formed between the respirator and the wearer's face.

10. The method of claim 9 further comprising the step of opening and closing a pair of passageways formed in the envelope to allow air flow from the exterior of the envelope to the interior of the envelope.

11. The method of claim 9 further comprising the step of using low adhesive contact surfaces to form the fluid seal between the longitudinal opening of the envelope and the periphery of the respirator.

12. The method of claim 9 further comprising the steps of:

removing a paper strip from a first low adhesive contact surface formed on the interior of the envelope adjacent to the longitudinal opening;

removing a second paper strip from a second low adhesive contact surface formed on the interior of the envelope adjacent to the longitudinal opening; and forming the fluid seal between the longitudinal opening of the envelope and the periphery of the respirator with the first and second low adhesive contact surfaces.

13. The method of claim 9 further comprising the step of folding a portion of the fluid impervious envelope to close the passageway and to block the flow of air between the exterior of the envelope and the interior of the envelope.

14. An apparatus for checking the fit of a respirator with the face of a wearer comprising:

an envelope formed from a sheet of flexible, fluid impervious material having a generally rectangular configuration with first: and second longitudinal sides and first and second lateral sides extending between the first and second longitudinal sides;

an opening formed in the first longitudinal side of the envelope and extending substantially the full length thereof;

the second longitudinal side of the envelope closed;

the first lateral side of the envelope sealed from the second longitudinal side to proximate the first longitudinal side;

the second lateral side of the envelope open from the first longitudinal side to the second longitudinal side;

low adhesive contact surfaces formed on the interior of the envelope adjacent to the opening formed in the first longitudinal side of the envelope; and the apparatus being engageable with the periphery of the respirator.

15. The apparatus of claim 14 wherein the opening in the second lateral side further comprises a passageway for controlling the flow of air from the exterior of the envelope to the interior of the envelope.

16. The apparatus of claim 14 wherein the sealed first lateral side and the closed second longitudinal side cooperate with each other to form a guide for positioning the envelope on the respirator.

17. Apparatus for checking the fit of a respirator with the face of a wearer comprising:

a longitudinal opening formed in one side of the envelope and extending substantially the full length thereof;

at least one passageway formed in the envelope for controlling the flow of air from the exterior of the envelope to the interior of the envelope;

low adhesive contact surfaces formed on the interior of the envelope adjacent to the longitudinal opening;

the envelope having a generally rectangular configuration with first and second longitudinal sides and first and second lateral sides extending between the first and second longitudinal sides;

the longitudinal opening formed in the first longitudinal side of the envelope;

the second longitudinal side of the envelope closed;

bonded areas formed along each lateral side of the envelope;

a passageway formed in each lateral side of the envelope adjacent to the second longitudinal side and extending through the respective bonded area; and a slot formed at both ends of the longitudinal opening and extending partially through the respective bonded areas.

18. Apparatus for checking the fit of a respirator with the face of a wearer comprising:

a longitudinal opening formed in one side of the envelope and extending substantially the full length thereof;

at least one passageway formed in the envelope for controlling the flow of air from the exterior of the envelope to the interior of the envelope;

low adhesive contact surfaces formed on the interior of the envelope adjacent to the longitudinal opening;

the envelope having a generally rectangular configuration with first and second longitudinal sides and first and second lateral sides extending between the first and second longitudinal sides;

the longitudinal opening formed in the first longitudinal side of the envelope;

the second longitudinal side of the envelope closed;

bonded areas formed along each lateral side of the envelope;

a passageway formed in each lateral side of the envelope adjacent to the second longitudinal side and extending through the respective bonded area; and a slot formed at one end of the longitudinal opening and extending partially through the respective bonded area.

19. Apparatus for checking the fit of a respirator with the face of a wearer comprising:

a longitudinal opening formed in one side of the envelope and extending substantially the full length thereof;

at least one passageway formed in the envelope for controlling the flow of air from the exterior of the envelope to the interior of the envelope;

low adhesive contact surfaces formed on the interior of the envelope adjacent to the longitudinal opening;

the envelope having a generally rectangular configuration with first and second longitudinal sides and first and second lateral sides extending between the first and second longitudinal sides;

the longitudinal opening formed in the first longitudinal side of the envelope;

the second longitudinal side of the envelope closed;

bonded areas formed along each lateral side of the envelope;

a passageway formed in one lateral side of the envelope adjacent to the second longitudinal side and extending through the respective bonded area; and a slot formed at one end of the longitudinal opening and extending partially through the respective bonded area.

20. Apparatus for checking the fit of a respirator with the face of a wearer comprising:

an envelope formed from a sheet of flexible, fluid impervious material and folded to have a generally rectangular configuration with first and second longitudinal sides and first and second lateral sides extending between the longitudinal sides;

an opening formed in the first longitudinal side of the envelope and extending substantially the full length thereof;

the second longitudinal side of the envelope closed;

at least one passageway formed in the envelope for controlling the flow of air from the exterior of the envelope to the interior of the envelope;

low adhesive contact surfaces formed on the interior of the envelope adjacent to the longitudinal opening;

a bonded area formed along each lateral side of the envelope;

a passageway formed in each lateral side of the envelope adjacent to the second longitudinal side and extending through the respective bonded area; and a slot formed at each end of the longitudinal opening and extending partially through the respective bonded area.

21. Apparatus for checking the fit of a respirator with the face of a wearer comprising:

an envelope formed from a sheet of flexible, fluid impervious material and folded to have a generally rectangular configuration with first and second longitudinal sides and first and second lateral sides extending between the longitudinal sides;

an opening formed in the first longitudinal side of the envelope and extending substantially the full length thereof;

the second longitudinal side of the envelope closed;

at least one passageway formed in the envelope for controlling the flow of air from the exterior of the envelope to the interior of the envelope;

low adhesive contact surfaces formed on the interior of the envelope adjacent to the longitudinal opening;

a bonded area formed along each lateral side of the envelope;

a passageway formed in each lateral side of the envelope adjacent to the second longitudinal side and extending through the respective bonded area; and a slot formed at one end of the longitudinal opening and extending partially through the respective bonded area.

22. Apparatus for checking the fit of a respirator with the face of a wearer comprising:

an envelope formed from a sheet of flexible, fluid impervious material and folded to have a generally rectangular configuration with first and second longitudinal sides and first and second lateral sides extending between the longitudinal sides;

an opening formed in the first longitudinal side of the envelope and extending substantially the full length thereof;

the second longitudinal side of the envelope closed;

at least one passageway formed in the envelope for controlling the flow of air from the exterior of the envelope to the interior of the envelope;

low adhesive contact surfaces formed on the interior of the envelope adjacent to the longitudinal opening;

a bonded area formed along each lateral side of the envelope;

a passageway formed in one lateral side of the envelope adjacent to the second longitudinal side and extending through the respective bonded area; and a slot formed at one end of the longitudinal opening and extending partially through the respective bonded area.

* * * * *